US006865755B2

(12) United States Patent
Barnett

(10) Patent No.: US 6,865,755 B2
(45) Date of Patent: Mar. 15, 2005

(54) INTERLOCKED DRAIN COVER

(75) Inventor: Ralph Lipsey Barnett, Wilmette, IL (US)

(73) Assignee: Triodyne Safety Systems, LLC, Northbrook, IL (US)

( * ) Notice: Subject to any disclaimer, the term of this patent is extended or adjusted under 35 U.S.C. 154(b) by 0 days.

(21) Appl. No.: 10/345,715

(22) Filed: Jan. 16, 2003

(65) Prior Publication Data

US 2004/0139541 A1 Jul. 22, 2004

(51) Int. Cl.[7] ..... E04H 4/06
(52) U.S. Cl. ..... 4/504; 4/507
(58) Field of Search ..... 4/287, 292, 504, 4/507, 509; 210/100, 169, 416.2

(56) References Cited

U.S. PATENT DOCUMENTS

| | | | | | |
|---|---|---|---|---|---|
| 3,616,916 | A | * | 11/1971 | Greene | 210/169 X |
| 3,620,372 | A | * | 11/1971 | Gordon | 210/169 |
| 4,485,011 | A | * | 11/1984 | Cole et al. | 210/100 X |
| 4,742,593 | A | | 5/1988 | Kallenbach | 15/17 |
| 4,973,403 | A | | 11/1990 | Kozey | 210/170 |
| 5,454,940 | A | | 10/1995 | Lakotish | 210/169 |
| 5,536,397 | A | | 7/1996 | D'Offay | 210/169 |
| 5,665,248 | A | | 9/1997 | McKiddy, II | 210/169 X |
| 5,809,587 | A | * | 9/1998 | Fleischer | 4/504 |
| 5,894,609 | A | | 4/1999 | Barnett | 4/504 |
| D410,073 | S | | 5/1999 | Barnett | D23/261 |
| 5,978,981 | A | | 11/1999 | Nelson | 4/504 X |
| 6,009,573 | A | | 1/2000 | Thibault | 4/504 X |
| D421,101 | S | | 2/2000 | Barnett | D23/261 |
| D421,102 | S | | 2/2000 | Barnett | D23/261 |
| D421,295 | S | | 2/2000 | Barnett | D23/261 |
| 6,088,842 | A | | 7/2000 | Barnett | 4/286 |
| D439,957 | S | | 4/2001 | Barnett et al. | D23/261 |
| 6,230,337 | B1 | | 5/2001 | Barnett | 4/507 |
| 6,295,661 | B1 | * | 10/2001 | Bromley | 4/504 |

* cited by examiner

*Primary Examiner*—Robert M. Fetsuga
(74) *Attorney, Agent, or Firm*—Pauley Petersen & Erickson

(57) ABSTRACT

Missing drain covers used in connection with swimming pools, spas and/or other applications expose humans and animals to discharge ports in the drains that can develop near vacuums which eviscerate, entrap the body and entangle hair. A drain cover is disclosed that releases an elastomeric plug in the neighborhood of the drain upon removal of the drain cover. The plug becomes entrained in the discharge flow and eventually plugs up the smaller diameter discharge port eliminating vacuum hazards by checking all discharge flow and pressure.

6 Claims, 6 Drawing Sheets

INTERLOCKED DRAIN COVER

BACKGROUND OF THE INVENTION

1. Field of the Invention

This invention relates to a drain cover assembly interlock having a releasable plug for obstructing a discharge port upon removal of a drain cover.

2. Description of Related Art

Properly designed pool and spa drain covers provide several safety functions; namely, they prevent or mitigate evisceration, hair entanglement, finger and toe entrapment and body suction entrapment. If the drain cover is missing from the drain, body entrapment and evisceration are prevalent hazards which are particularly devastating to children. These hazards arise because of the drain suction from the now exposed discharge port positioned behind the drain cover.

The suction associated with evisceration and body and limb entrapment may be eliminated by "interlocking" the drain cover, i.e., when the covers are removed all flow and suction are interrupted.

SUMMARY OF THE INVENTION

Accordingly, it is one object of this invention to provide a drain cover assembly that interrupts suction from the discharge port upon removal of the drain cover.

It is another object of this invention to provide a drain cover assembly that discharges a plug into the discharge port upon removal of the drain cover.

It is another object of this invention to provide a drain cover assembly that retains a plug, such as a ball, within a retainer that responsively releases the ball into the path of the discharge port upon removal of the drain cover.

It is another object of this invention to provide an interlocked drain cover assembly that includes components that will not entangle a bather's or swimmer's hair.

These and other objects of this invention are addressed by a drain cover that responsively releases a suitably-sized plug, such as an elastomeric ball preferably having a diameter somewhat larger than the drain discharge port, into the vicinity of the drain when the drain cover is removed. This ball becomes entrained in the discharge flow and, because of its size, lodges itself in the entrance to the drain discharge port which is somewhat smaller in diameter than the ball. This "check valve" action isolates a swimmer from the suction proclivities of the drainage pump.

Several devices are described for securing the ball when the drain cover is in situ; such devices release the ball when the cover is removed. The freely movable nature of the unrestrained ball is a unique attribute of the present invention. The unrestrained ball will be urged into contact with the discharge outlet by water flow, gravity and/or other means. To function efficiently, two additional properties should be realized: hair entanglement with the interlock mechanism should be minimized or eliminated; and the flow rate should not be compromised significantly.

BRIEF DESCRIPTION OF THE DRAWINGS

These and other objects and features of this invention will be better understood from the following descriptions taken in conjunction with the drawings wherein.

DETAILED DESCRIPTION OF THE PREFERRED EMBODIMENTS

Figure 1:
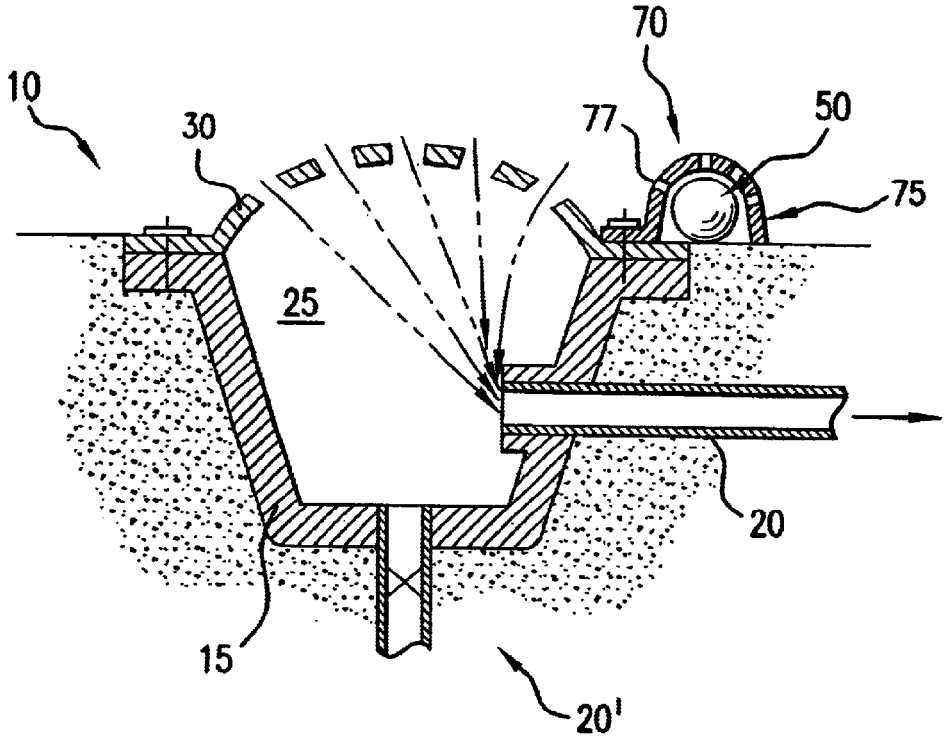
FIG. 1 is a side cross-sectional view of a drain cover assembly in situ, according to one preferred embodiment of this invention.

FIGS. 1–15 show various embodiments of drain cover assembly 10. Drain cover assembly 10 according to this invention is preferably used in connection with swimming pools, spas, whirlpool baths and other vessels that require drains drawing water, particularly where bathers and/or swimmers may come into contact with such drains. Applicant has used the term "pool" surface to describe the surface or surfaces adjacent drain cover assembly 10, however such term is intended to also describe whirlpools, bathtubs, spas and any other similar surface having a recessed discharge drain 15 with a discharge port 20 out of a drain cavity 25.

According to a preferred embodiment of this invention, drain cover assembly 10 includes drain cover 30 configured for attachment with respect to discharge drain 15 and plug 50 retained by at least a portion of drain cover 30, such as retainer 70. Preferably, plug 50 is an unattached plug, i.e. not attached or connected to drain cover 30, as shown in FIGS. 1–15. Plug 50 is responsively discharged from drain cover 30 upon removal of drain cover 30 from discharge drain 15. Plug 50 is then responsively positioned, by flow of the water, over discharge port 20 thereby blocking fluid flow into discharge port 20. Various specific embodiments of this invention are described in more detail below.

According to a preferred embodiment of this invention, and as shown in the drawings, plug 50 comprises a ball, more specifically an elastomeric ball preferably having a diameter larger than a diameter of discharge port 20. Plug 50 or ball 50 may be elastomeric, polymeric or any other structure, preferably having flexible, deformable and/or conforming characteristics. However, additional shapes, configurations and materials are contemplated for use as plug 50 including polyhedrons, discs, cones and any other suitable shape having suitable properties to block fluid flow into discharge port 20. However, the term "ball" will be used throughout the remaining specification for the purposes of consistency.

In addition, ball 50 preferably has a specific gravity greater than unity so that the ball does not float and is thereby, when released, more easily urged into contact with the discharge port 20. Ball 50 may comprise a material having a lower specific gravity however a tether or other device may be necessary to maintain ball 50 within close proximity to discharge port 20.

The following headings and related descriptions describe various preferred embodiments of the present invention. Other variations are contemplated that accomplish the same purpose of releasing a plug into the vicinity of a discharge port upon removal of a drain cover.

FIGS. 1–15 show that discharge drains 15 may be configured with two discharge ports 20 and 20'. Usually one discharge port is open, shown as element 20, and one is plugged, shown as element 20'. The preferred embodiments of this invention work equally well when discharge port 20 is plugged and discharge port 20' is open. Further, the preferred embodiments of this invention work equally well when both discharge port 20 and discharge port 20' are open; but then require that drain cover assembly 10 include two cup and ball assemblies.

External Ball Retention

Figure 2:
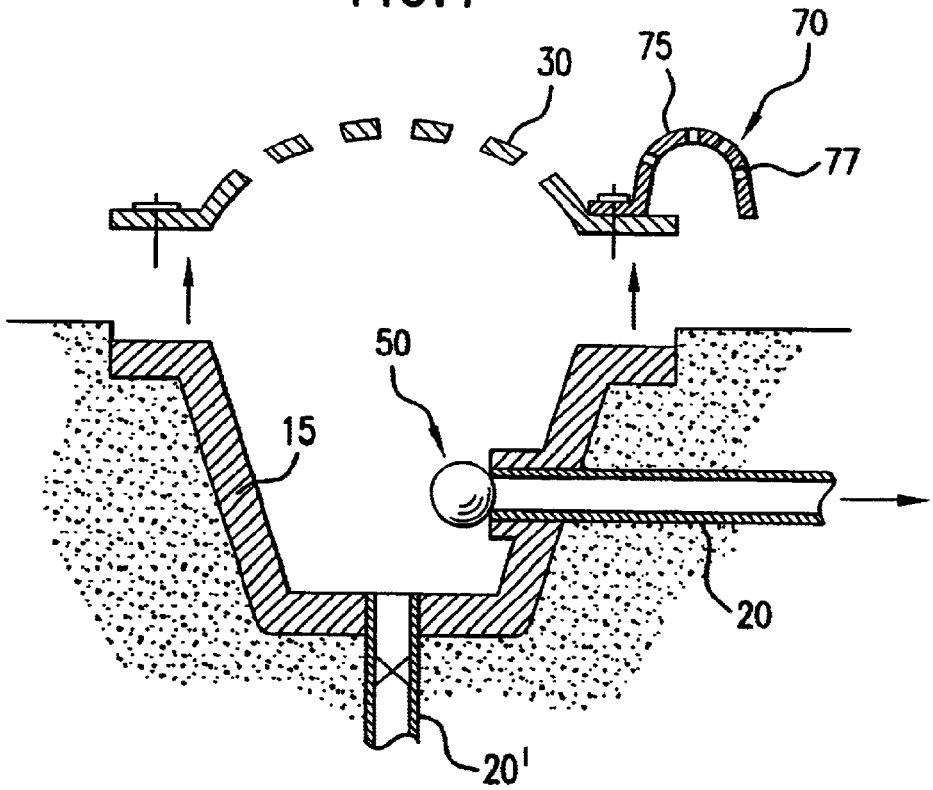
FIG. 2 is a side cross-sectional view of the drain cover assembly shown in FIG. 1, in a ball plug deployed position.

FIGS. 1 and 2 show one preferred embodiment of this invention wherein retainer 70 is associated with drain cover assembly 10 and includes a generally spherical segment, such as cup 75 for restraining ball 50. As shown in FIG. 1, cup 75 is positioned outside of drain cover 30 relative to drain cavity 25 and restrains ball 50 against the surface of the pool floor. By positioning cup 75 outside of drain cavity 25, the flow rate of the drain system is not reduced by retainer 70. In addition, hair entrapment or entanglement is eliminated or minimized by positioning cup 75 flush with the bottom surface of the pool.

Cup 75 preferably protects the ball from UV radiation, particularly an elastomeric ball. Cup 75 may include one or more holes 77 to permit viewable confirmation of the presence of ball 50 in retainer 70. Conventional wisdom in the aquatics industry suggests that small holes will not entangle hair. Cup 75 may be constructed of stainless steel or other material that will not degrade in the pool environment.

According to this embodiment of the invention, and as shown from FIG. 1 to FIG. 2, removal of drain cover 30 releases ball 50 which will quickly be entrained into the water discharge flow pattern. This will bring ball 50 up against the discharge port 20 in drain 15 as shown in FIG. 2. Because the ball diameter is preferably larger than the inside diameter of discharge port 20, ball 50 will remain fixed to discharge port 20 thereby stopping all fluid flow therethrough. As a result, when drain cover 30 is removed from the drain, either intentionally or accidently, ball 50 will obstruct discharge port 20 thereby maintaining a safe condition in the vicinity of the drain.

The safe flow rate established for drain cover 30 using the protocol in ASME/ANSI A112.19.8M-1987 is unaffected by the interlock drain cover assembly 10 described herein and shown in FIGS. 1 and 2. Two cup and ball interlocks may be used if two discharge ports 20, 20' are active in drain cavity of the main drain.

According to a preferred embodiment of this invention, ball 50 should have a specific gravity greater than unity. This prevents flotation of ball 50 and thus ensures that ball 50 is urged into drain cavity 25 by gravity and water flow and remains in the vicinity of discharge port 20.

Internal Ball Retention

Figure 3:
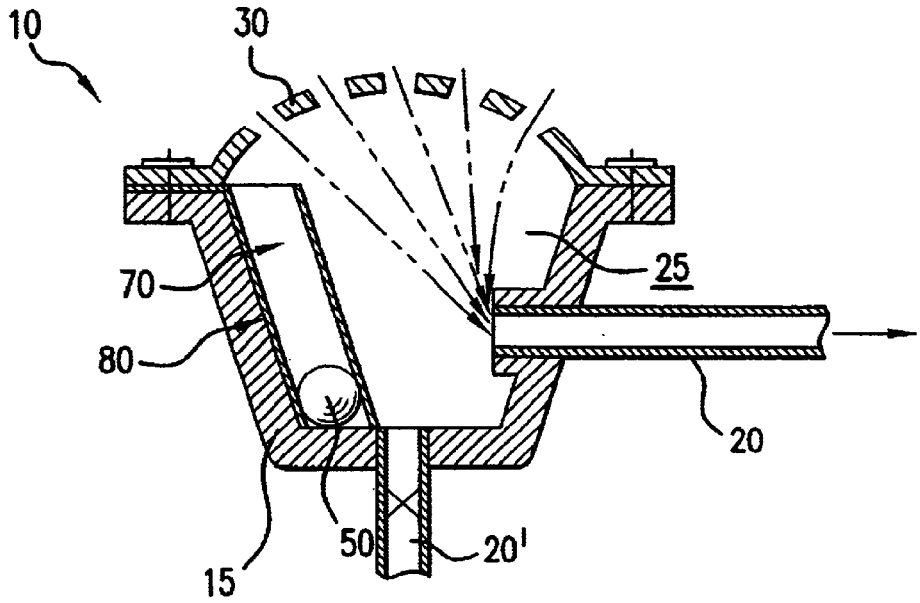
FIG. 3 is a side cross-sectional view of a drain cover assembly in situ, according to one preferred embodiment of this invention.
Figure 4:
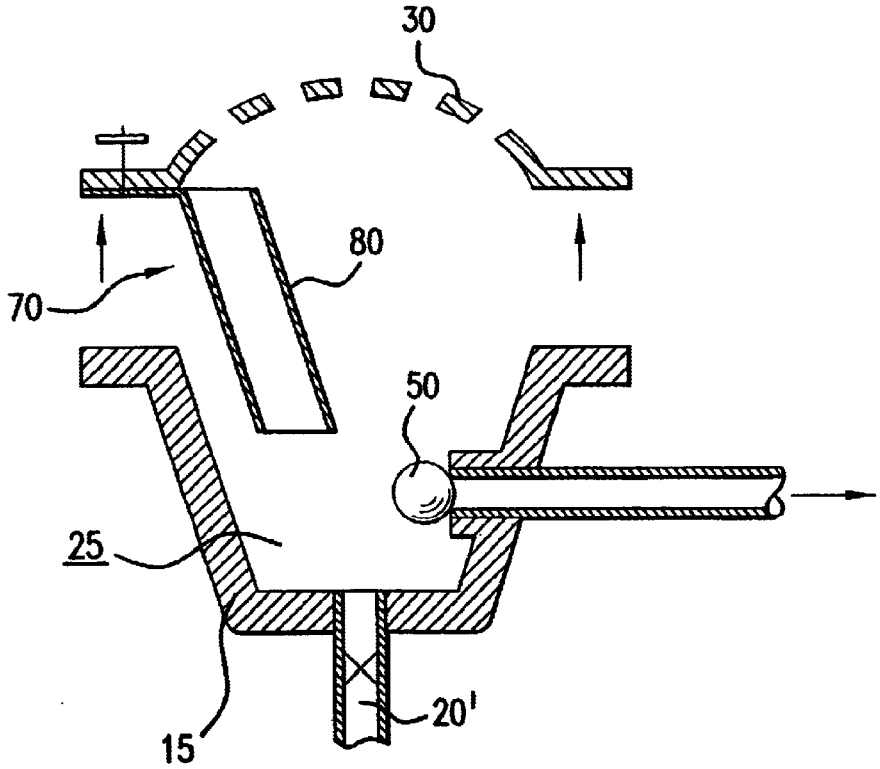
FIG. 4 is a side cross-sectional view of the drain cover assembly shown in FIG. 3, in a ball plug deployed position.

According to a preferred embodiment of this invention shown in FIGS. 3 and 4, retainer 70 includes tube 80 associated with or integrated with drain cover 30. Tube 80 preferably extends downwardly into drain cavity 25 bound by drain cover 30. Ball 50 is preferably positioned within tube 80 which surrounds and/or encloses ball 50 until drain cover 30 is removed or disassociated from the vicinity of discharge port 20.

As shown in FIG. 3, tube 80 preferably extends from drain cover 30 downwardly until flush with a bottom surface of drain cavity 25 against which ball 50 is retained. Tube 80 is preferably tightly fitted against the side wall within drain cavity 25, in part to minimize flow rate disruptions through discharge port 20.

As described above, ball 50 is preferably elastomeric and is captured within tube 50. The diameter of ball 50 is preferably somewhat larger than the diameter of discharge port 20. Ball 50 preferably has a specific gravity greater than unity if it is solid. In general, ball 50, solid or not, should sink in water, in part, to maintain a close proximity to discharge port 20 in the event that drain cover 30 is removed. Two balls 50 may be used in tube 80 when two discharge ports 20, 20' are active. If tube 80 is closed at the top, ball 50 will be protected from UV attack.

As shown in FIG. 4, when drain cover 30 is removed, ball 50 is released into the discharge flow. Ball 50 will be pulled against discharge port 20 by the water flow through discharge port 20 and will accordingly block all fluid flow into and through discharge port 20 by the vacuum generated therein.

Human hair cannot be entangled around tube 80 because tube 80 preferably remains flush against the side and bottom of drain cover 30 during normal operation with drain cover 30 in situ.

Internal Ball Retention—Tube on Discharge Port

Figure 5:
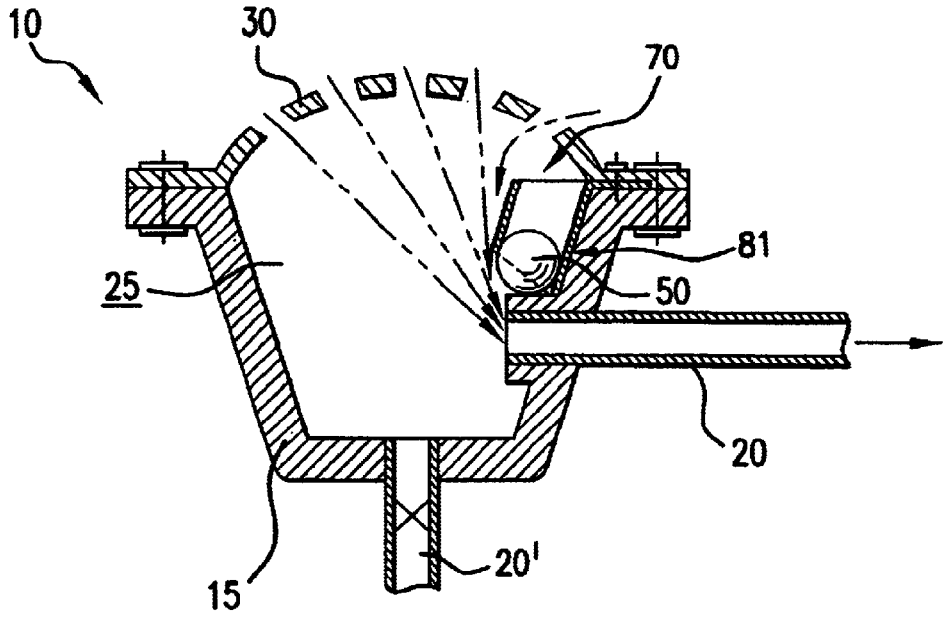
FIG. 5 is a side cross-sectional view of a drain cover assembly in situ, according to one preferred embodiment of this invention.
Figure 6:
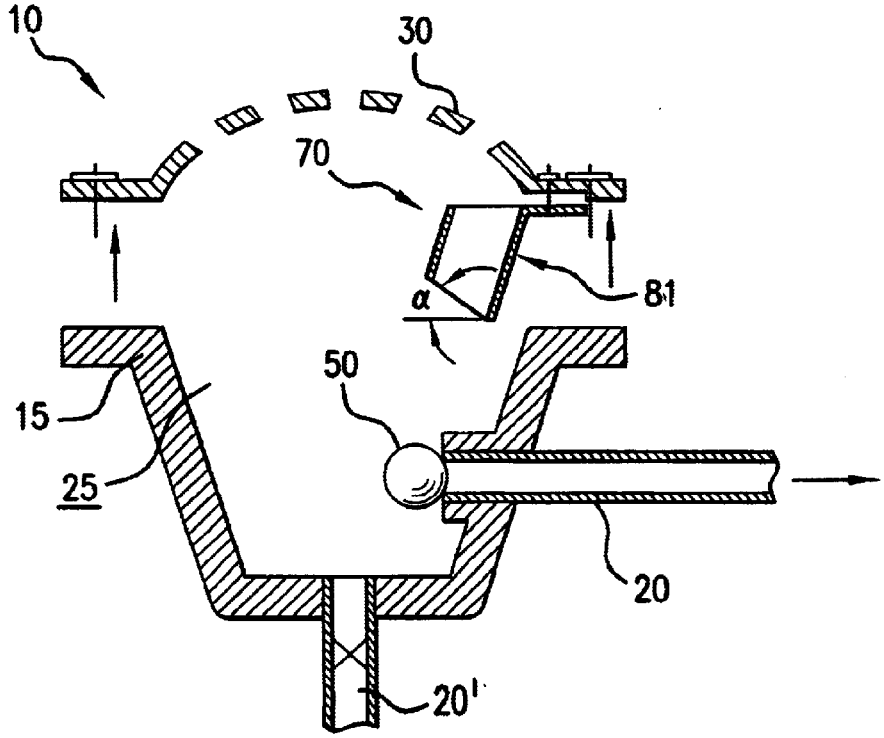
FIG. 6 is a side cross-sectional view of the drain cover assembly shown in FIG. 5, in a ball plug deployed position.

According to a preferred embodiment of this invention shown in FIGS. 5 and 6, drain cover assembly 10 includes retainer 70 having tube 81 associated with or integrated with drain cover 30 and extending downwardly into drain cavity 25 bound by drain cover 30. Like the embodiment described for FIGS. 3 and 4, tube 81 preferably surrounds ball 50 until drain cover 30 is removed from discharge port 20. However, according to this preferred embodiment and as best shown in FIG. 5, tube 81 extends from drain cover 30 into proximity with and above discharge port 20 instead of flush with a lower surface of drain cavity 25.

In addition, a lower edge of tube 81 includes an angled edge to prevent hair entanglement. The bottom end of tube 91 is preferably cut on an angle to prevent hair from hanging up or becoming entangled on the bottom end of tube 81. The bottom plane of tube 81 should include an angle $\alpha$ with the horizontal plane such that $\alpha \geqq \tan^{-1}\mu$, where $\mu$ is the friction coefficient between the tube material and human hair. $\alpha$ is preferably less than 45° to retain ball 50 in tube 81 when drain cover 30 is in situ.

As described above, ball 50 is preferably elastomeric and is captured within tube 81 while resting on the protrusion of port 20 as shown in FIG. 5. The diameter of ball 50 is preferably somewhat larger than the inside diameter of discharge port 20. Ball 50 preferably has a specific gravity greater than unity if it is solid. In general, ball 50 should sink in water, in part, to maintain a close proximity to discharge port 20 in the event that drain cover 30 is removed. Two balls 50 may be used in tube 81 when two discharge ports are active, specifically in deep main drains where there may be enough tube 81 height to capture two elastomeric balls. A cap at the top end of tube 81 may be used to protect ball 50 from UV attack.

As shown in FIG. 6, when drain cover 30 is removed, ball 50 is released into the flow pattern of fluid through drain cavity 25 and into drain port 20. Ball 50 will quickly seal itself against discharge port 20 when its diameter is somewhat larger than that of drain port 20 in drain cavity 25. Fluid flow is thereby terminated and no suction-related hazards are present at drain cavity 25.

Internal Ball Retention—Stem and Hoop

FIGS. 7–15 show drain cover assembly 10 wherein retainer 70 includes stem 90 extending downwardly from drain cover 30 and hoop 95 (FIGS. 7–9); capped tube 100 (FIGS. 10–12); or cup 105 (FIGS. 13–15) positioned at a distal end of stem 90.

Figure 7:
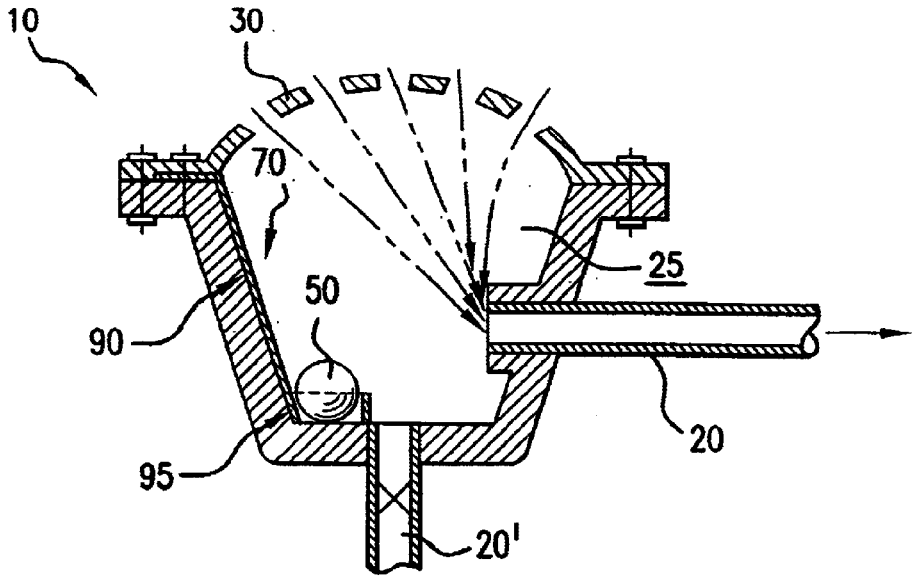
FIG. 7 is a side cross-sectional view of a drain cover assembly in situ, according to one preferred embodiment of this invention.
Figure 8:
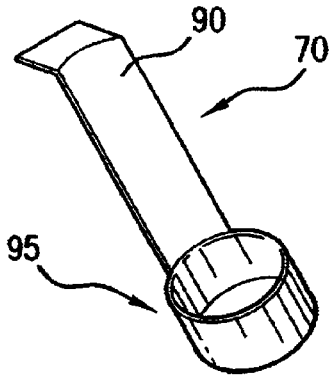
FIG. 8 is a perspective view of a ball plug retainer according to one preferred embodiment of this invention.
Figure 9:
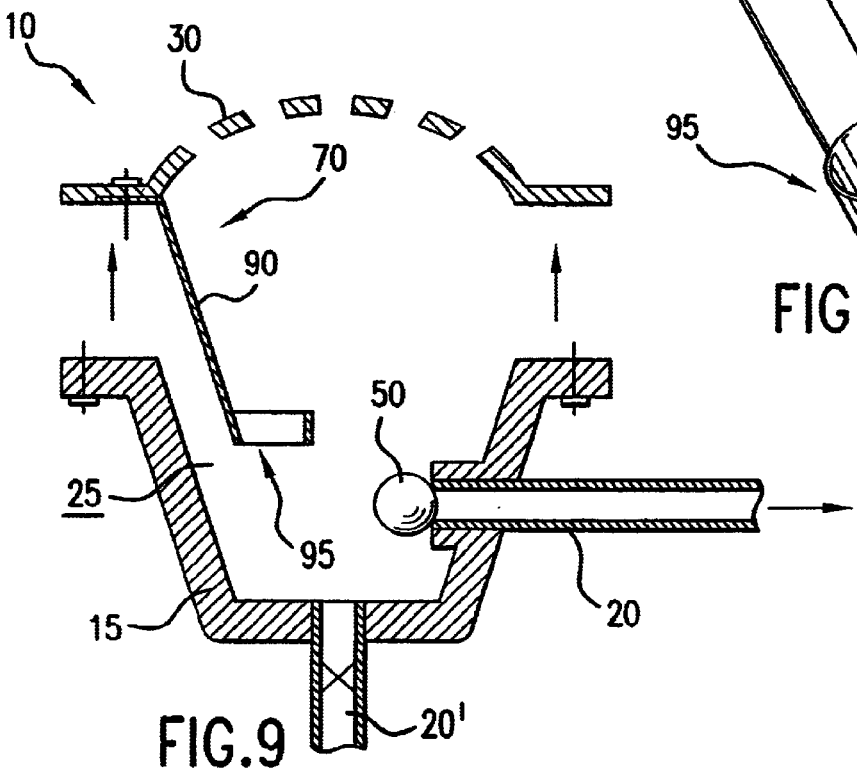
FIG. 9 is a side cross-sectional view of the drain cover assembly shown in FIG. 7, in a ball plug deployed position.

FIGS. 7–9 show a preferred embodiment of this invention having hoop 95 attached to a distal end of stem 90. Hoop 95 preferably includes an open lower edge generally flush with a bottom surface of drain cavity 25 formed behind drain cover 30.

Stem 90 and hoop 95, such as shown in FIG. 8, are preferably corrosion-resistant metal, or other suitable material, and are preferably fastened to drain cover 30 so that stem 90 hugs the side wall of drain cavity 25. Stem 90 is preferably of a sufficient length and shape to position hoop 95 against the bottom of drain cavity 25. Hair cannot become entangled with retainer 70 of this embodiment because both stem 90 and hoop 95 preferably remain flush against the drain structure 15 defining drain cavity 25.

Ball 50, preferably elastomeric and somewhat heavier than water so it sinks, is retained in hoop 95 while drain cover 30 remains in situ. When drain cover 30 is removed, the previously captured ball 50 is released into the discharge flow of the drain cavity 25 and is brought against the mouth of discharge port 20 by the water flow through discharge port 20. Because ball 50 has a larger diameter than that of discharge port 20, ball 50 will seal discharge port 20 against further discharge flow. All suction hazards are thereby removed by this action at drain cavity 25.

Figure 10:
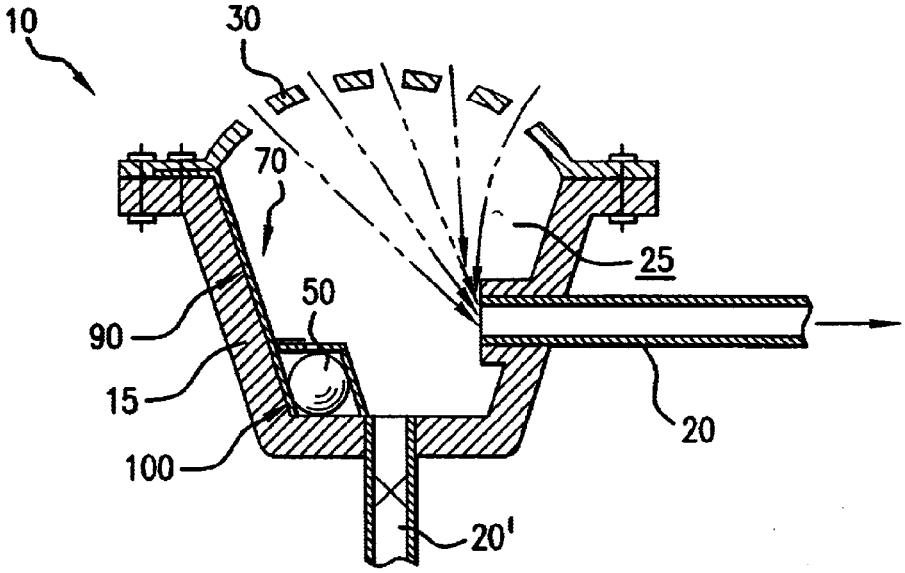
FIG. 10 is a side cross-sectional view of a drain cover assembly in situ, according to one preferred embodiment of this invention.
Figure 11:
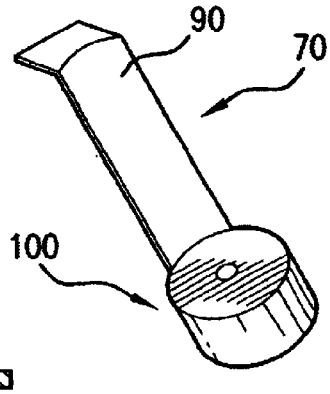
FIG. 11 is a perspective view of a ball plug retainer according to one preferred embodiment of this invention.
Figure 12:
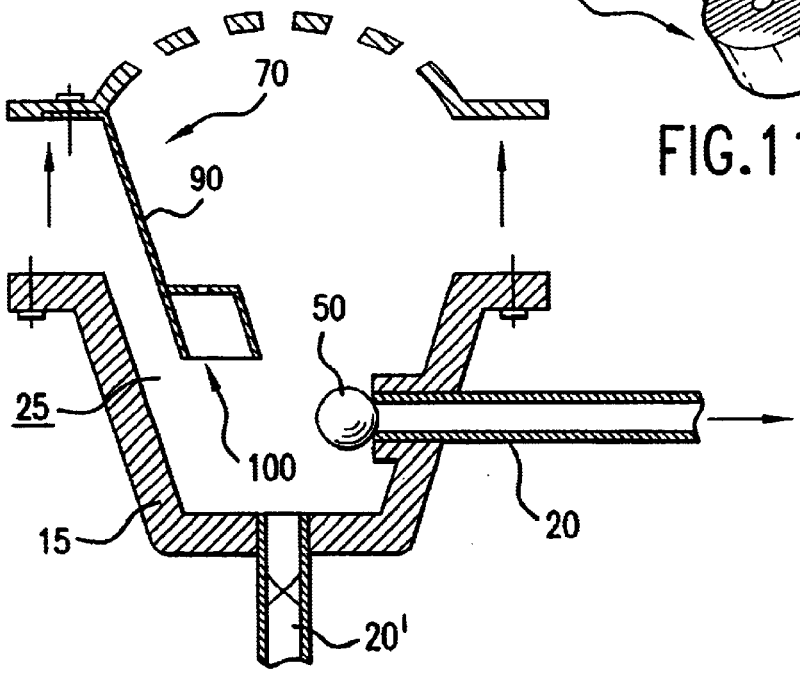
FIG. 12 is a side cross-sectional view of the drain cover assembly shown in FIG. 10, in a ball plug deployed position.

FIGS. 10–12 show drain cover assembly 10 having retainer 70 that includes stem 90 extending downwardly from drain cover 30 and a tube 100 capped on top but open at the bottom attached to a distal end of stem 90. The open bottom end of tube 100 is in generally flush contact with the bottom surface of drain cavity 25.

Ball 50, preferably elastomeric and somewhat heavier than water so that it sinks, is retained in capped tube 100 while drain cover 30 remains in situ, such as shown in FIG. 10. When drain cover 30 is removed, the previously captured ball 50 is released into the discharge flow of drain cavity 25 and is brought against the mouth of discharge port 20 by the water flow through discharge port 20, such as shown in FIG. 12. Because ball 50 has a larger diameter than that of discharge port 20, ball 50 will seal discharge port 20 against further discharge flow. All suction hazards are thereby removed at drain cavity 25 by this action.

Figure 13:
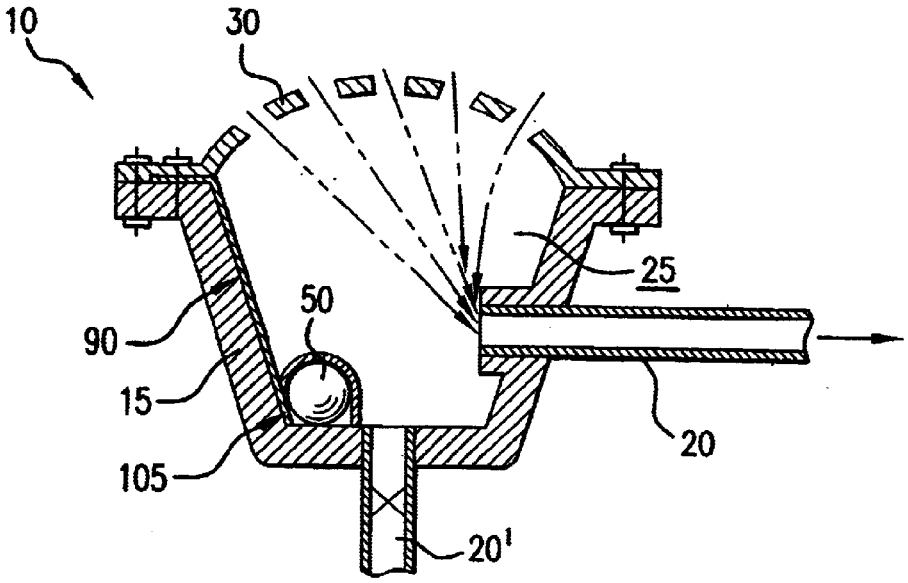
FIG. 13 is a side cross-sectional view of a drain cover assembly in situ, according to one preferred embodiment of this invention.
Figure 14:
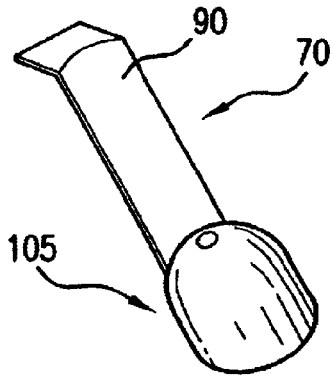
FIG. 14 is a perspective view of a ball plug retainer according to one preferred embodiment of this invention.
Figure 15:
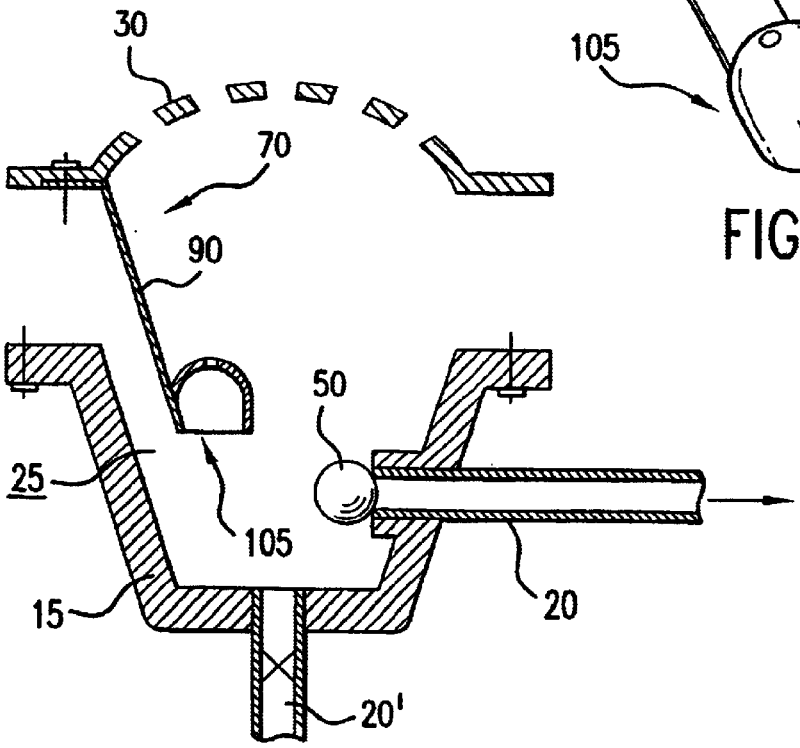
FIG. 15 is a side cross-sectional view of the drain cover assembly shown in FIG. 13, in a ball plug deployed position.

FIGS. 13–15 show drain cover assembly 10 having retainer 70 that includes stem 90 extending downwardly from drain cover 30 and cup 105 attached to a distal end of stem 90. The open bottom end of cup 105 is in generally flush contact with the bottom surface of drain cavity 25.

Ball 50, preferably elastomeric and somewhat heavier than water so it sinks, is retained in cup 105 while drain cover 30 remains in situ, as shown in FIG. 13. When drain cover 30 is removed, the previously captured ball 50 is released into the discharge flow of drain cavity 25 and is brought against the mouth of discharge port 20 by the water flow through discharge port 20, as shown in FIG. 15. Because ball 50 has a larger diameter than that of discharge port 20, ball 50 will seal discharge port 20 against further discharge flow. All suction hazards are thereby removed at drain cavity 25 by this action.

The embodiments of this invention as described and shown in FIGS. 7–15, should include ball 50 that is heavier than water so it should sink. If solid, ball 50 should have a specific gravity greater than unity. A UV resistant ball 50 is desired to survive the pool environment.

The bottom area of drain cavity 25 should be large enough to accommodate the preceding embodiments without compromising the flow rate of the discharge system.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A drain cover assembly for attachment over a drain having a discharge port recessed within a swimming pool floor wherein the discharge port generates suction, the drain cover assembly comprising:

a drain cover configured for attachment with respect to the discharge port;

a retainer connected to the drain cover; and a freely movable and unattached plug normally retained in association with the drain cover and apart from the discharge port and within the retainer, or within the retainer, the freely movable plug responsively released from within the retainer and positionable over the discharge port upon removal of the drain cover from the discharge port.

2. The drain cover of claim 1 wherein the plug is formed of an elastomeric material having a specific gravity greater than unity.

3. A drain cover assembly comprising:

a drain cover configured for attachment with respect to a drain having at least one discharge port:

a plug retained by the drain cover, the plug responsively discharged from the drain cover upon removal of the drain cover from the drain and positionable over the discharge port thereby blocking fluid flow into the discharge port: and a cup positioned outside of the drain cover, the cup restraining the plug against a surface adjacent to the drain.

4. A drain cover assembly for attachment over a drain having at least one discharge port recessed within a surface wherein the discharge port accommodates fluid flow out of the drain, the drain cover assembly comprising:

a drain cover configured for attachment over the drain;

a retainer comprising a cup positioned outside of the drain cover; and a ball positioned within the retainer, the ball restrained against the surface with the cup and releasable from the retainer upon removal of the drain cover and sized to cover an end of the discharge port and thereby block fluid flow into the discharge port.

5. The drain cover assembly of claim 4 wherein the cup includes one or more holes to permit viewable confirmation of the presence of the ball.

6. The drain cover assembly of claim 4 wherein the ball comprises a conforming material having a specific gravity greater than unity.

* * * * *